US006439878B1

(12) United States Patent
Kawauchi et al.

(10) Patent No.: US 6,439,878 B1
(45) Date of Patent: Aug. 27, 2002

(54) APPARATUS FOR CONTROLLING COMBUSTION DEVICE

(75) Inventors: Hajime Kawauchi; Toshihisa Terade, both of Ishikawa-ken (JP)

(73) Assignee: RB Controls Co., LTD, Kanazawa (JP)

( * ) Notice: Subject to any disclaimer, the term of this patent is extended or adjusted under 35 U.S.C. 154(b) by 0 days.

(21) Appl. No.: 09/906,699

(22) Filed: Jul. 18, 2001

(30) Foreign Application Priority Data

Oct. 17, 2000 (JP) ..... 2000-316751

(51) Int. Cl.[7] ..... F23N 5/00
(52) U.S. Cl. ..... 431/70; 431/18; 431/24
(58) Field of Search ..... 431/13, 18, 19, 431/20, 24, 70, 62, 69; 236/10, 11; 126/116 A, 116 R

(56) References Cited

U.S. PATENT DOCUMENTS 4,982,721 A * 1/1991 Lynch ..... 431/12

FOREIGN PATENT DOCUMENTS

JP 4-174213 * 6/1992 ..... 431/18
JP 5-99432 * 4/1993 ..... 431/13

* cited by examiner

*Primary Examiner*—James C. Yeung
(74) *Attorney, Agent, or Firm*—Arent Fox Kintner Plotkin & Kahn, PLLC.

(57) ABSTRACT

When an error occurs to a combustion device, a microcomputer inside a control apparatus for the combustion device closes a safety valve thereby stopping gas supply to a gas burner. In a conventional control apparatus, when a power source resetting is actuated with a power switch, the safety valve is opened to supply the gas burner with gas even though the cause for the error has not been resolved. As a solution, when an error occurs, the fact of such an occurrence is stored in a nonvolatile memory, i.e., electrically erasable programmable read-only memory, EEPROM. It is so arranged that, unless the reset switch is operated, the memory in the EEPROM is not reset. After resetting, the memory in the EEPROM is read out. As long as the reset has not been made, the safety valve is not opened, but the program immediately proceeds to a state in which the operation of the reset switch is held in suspension.

5 Claims, 3 Drawing Sheets

APPARATUS FOR CONTROLLING COMBUSTION DEVICE

BACKGROUND OF THE INVENTION

1. Field of the Invention

The present invention relates to an apparatus for controlling with a microcomputer a combustion device having a combustion section such as a gas burner or the like.

2. Description of Related Art

Conventionally, this kind of apparatus for controlling a combustion device detects various abnormal conditions which take place inside the combustion device. When there occurs a system error which takes place inside a control unit inclusive of a central processing unit (CPU) of a microcomputer, or when there occurs an operation error which is judged by an external signal to be inputted into the control unit, such as a flame failure or the like in a state in which a gas burner is expected to be in operation, a safety valve which is interposed in a gas supply pipe to supply the gas burner with gas is forcibly closed, whereby unburned gas is prevented from being discharged out of the gas burner. The occurrence of the abnormal condition is then alarmed by means of a sound and/or a lamp.

This kind of the combustion device is provided with a reset switch. If an operator or a user of the combustion device has removed the cause for the abnormal condition upon checking the combustion device, and if removed the cause for the abnormal condition to have been removed, he operates the reset switch thereby restoring the microcomputer back to the normal control state.

It is true that the microcomputer is restored by the operation of the reset switch. However, when the power is switched on after being once switched off, the power resetting (i.e., resetting through switching on the electric power) is actuated. As a result, the microcomputer will be reset without operating the reset switch. It is to be noted here that, when the power resetting is actuated, a confirmation is not always made as to whether the cause for the abnormal condition has been removed or not. Therefore, there is a disadvantage in that the microcomputer is reset although the cause for the abnormal condition has not been removed.

In view of the above disadvantage, the present invention has an object of providing an apparatus for controlling a combustion device in which the state of stopping the operation of the combustion device is maintained even if the microcomputer is reset through power resetting, unless the reset switch is operated.

SUMMARY OF THE INVENTION

In order to attain the above and other objects, the present invention is an apparatus for controlling a combustion device, the combustion device having a microcomputer for detecting various abnormal conditions which occur in the combustion device and for performing a predetermined processing such as stopping an operation of the combustion device when such abnormal conditions have been detected, the apparatus comprising: a reset switch for resetting the microcomputer; a nonvolatile memory, wherein, when a particular abnormal condition among the various abnormal conditions has occurred, a number of occurrence of the particular abnormal condition is stored in said nonvolatile memory, and wherein, when the microcomputer is reset without resort to the reset switch, the operation of the combustion device is held in a suspended state until the reset switch is operated if the number of occurrence, stored in the nonvolatile memory, of the particular abnormal condition is equal to a predetermined number.

In the conventional apparatus for controlling the combustion device, the number of occurrence of abnormal conditions is stored in a random access memory (RAM). Therefore, if the power is switched off, the memory contained inside the RAM disappears. As a result, even if the cause for the abnormal conditions has not been removed or resolved, once the power resetting is actuated, an ordinary combustion control is started again after the power is switched on.

In the present invention, on the other hand, since the number of occurrence of the particular abnormal condition is stored in the nonvolatile memory, the number of occurrence of the particular abnormal condition will not disappear even if the power is switched off. As a result, even if the power resetting is actuated, it can be judged that the cause for the particular abnormal condition has not been resolved, by checking the number of occurrence of the particular abnormal condition inside the nonvolatile memory when the power is switched on. Once the reset switch is operated, it can be assumed that the cause for the particular abnormal condition has been resolved. The number of occurrence of the particular abnormal condition stored in the nonvolatile memory may thus be reset to zero.

The above-described predetermined number may be set to "1" so that, whenever the particular abnormal condition occurs, the operation of the combustion device is stopped immediately. However, if the operation of the combustion device is stopped also at the time of wrong detection of an abnormal condition due to noises or the like, the combustion device will have to be stopped frequently. As a result, the reset switch must be operated each time of such a stopping to the trouble of the operator. To avoid such a trouble, it is preferable to set the above-described predetermined number to "2." If it is so arranged that the microcomputer is reset by software at the time of the first occurrence of the above-described particular abnormal condition, the wrong detection can be dealt with by resetting by software. If the combustion device is really abnormal, the detection of abnormal conditions continues. The operation of the combustion device may be stopped only when the particular abnormal condition has been detected for two times or more.

In case abnormal conditions are frequently detected in a rapid succession when the operator of the combustion device has presumably removed the cause for the abnormal conditions, it is considered that the problem lies in the environment in which the combustion device is being used. Therefore, if the number of operation of the reset switch within a given period of time has reached a predetermined upper limit value, it is preferable to temporarily prohibit the resetting of the microcomputer by means of the reset switch. It is thus so arranged that the environment in which the combustion device is being used must then be checked.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
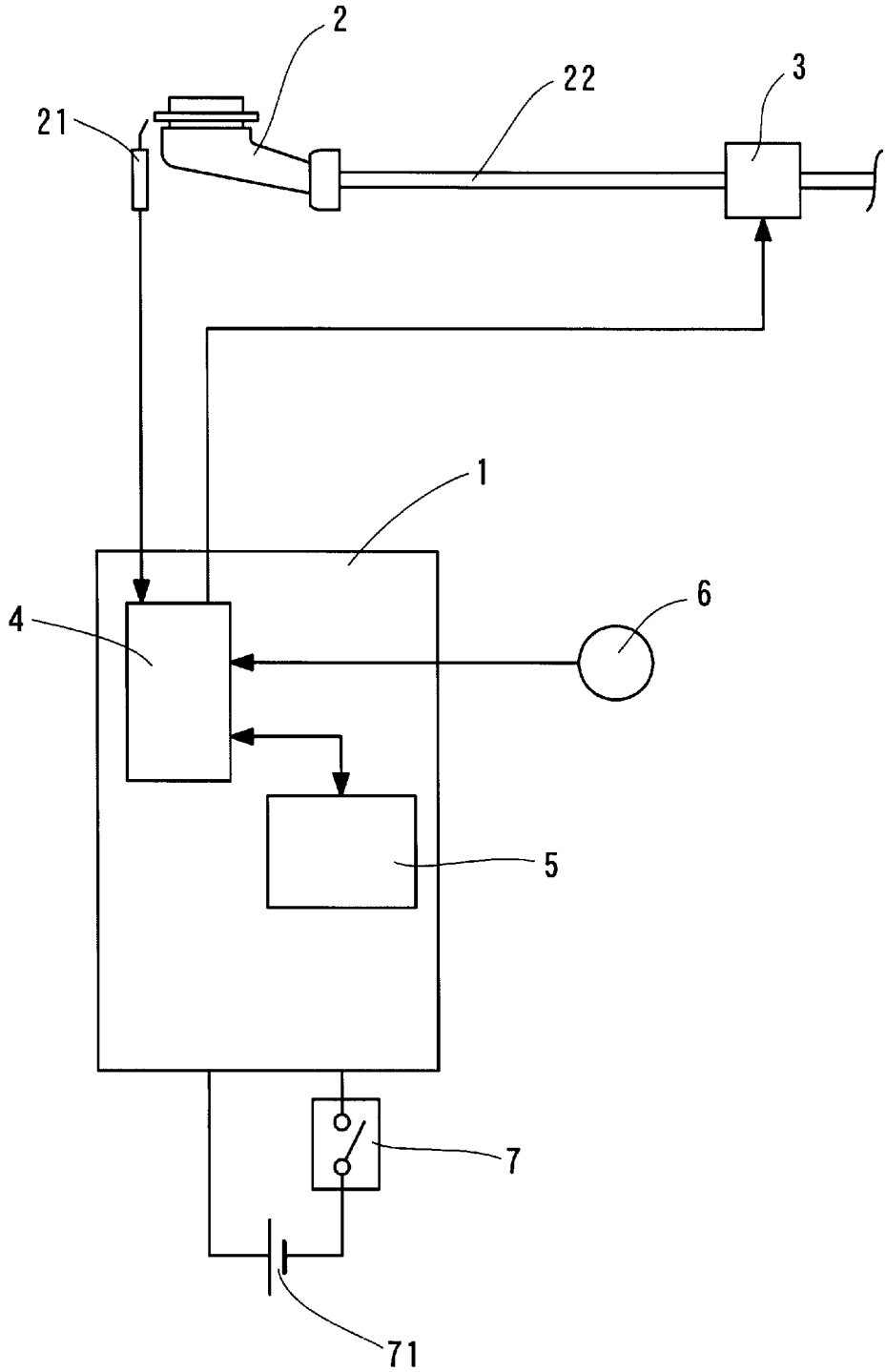
FIG. 1 is a schematic diagram to show the arrangement of one example of the present invention.

In FIG. 1, reference numeral 1 denotes an apparatus for controlling the operation of a combustion device which is provided with a gas burner 2 (this apparatus is also called a "control apparatus 1"). In the neighborhood of a flame peep hole (not illustrated) of the gas burner 2, there is disposed a flame rod 21 which detects a flame of the gas burner 2 by utilizing a rectifying function of the flame. There is further interposed a solenoid-operated safety valve 3 in a gas supply pipe 22 which supplies the gas burner 2 with gas.

The control apparatus 1 contains therein a microcomputer 4. A signal detected by the flame rod 21 is inputted into the microcomputer 4, which controls the opening and closing of the safety valve 3.

Reference numeral 5 denotes an electrically erasable programmable read-only memory (EEPROM). The EEPROM 5 has a function of rewriting the stored contents with an electric signal from the microcomputer 4. The stored memory thus does not disappear even if a power switch 7 is switched off whereby the power supply from an electrical power source 71 is stopped.

If the power switch 7 is once switched off thereby stopping the power supply to the microcomputer 4, and thereafter the power switch 7 is switched on thereby resuming the power supply to the microcomputer 4, the microcomputer 4 is reset. The resetting by means of the power switch 7 is called power resetting. The microcomputer 4 has connected thereto a reset switch 6. It is so programed that, when the microcomputer 4 has detected the operation of the reset switch 6, the microcomputer 4 is reset.

The microcomputer 4 is so arranged that, when the occurrence of an abnormal condition has been detected, a predetermined processing is performed depending on the kind of the abnormal condition. In case of abnormal conditions which are relatively serious in nature, the safety valve 3 is closed thereby stopping the supply of the gas burner 2 with the gas. The operation of the combustion device is then held in a suspended or stopped state. The abnormal condition in which the operation of the combustion device is held suspended is called a lockout error, which is largely classified into the following two kinds.

A first lockout error is called a system error which is an abnormal condition occurring inside an electronic unit within the control apparatus 1 or inside the microcomputer 4. It includes such an abnormal condition in which a signal for opening or closing the safety valve 3 and a feedback signal from the safety valve 3 do not theoretically coincide with each other, or an abnormal condition which is detected by a mirror check of the RAM inside the microcomputer 4.

A second lockout error is called an operation error which is an error that can be detected based on the information from a sensor, e.g., from the flame rod 21, which is other than the electronic unit within the control apparatus 1. The operation error includes an abnormal condition in which, e.g., the flame rod 21 fails to detect the presence of the flame, and an abnormal condition in which an overheat safety device (not illustrated), i.e., a safety device against an overheated condition, is actuated.

Figure 2:
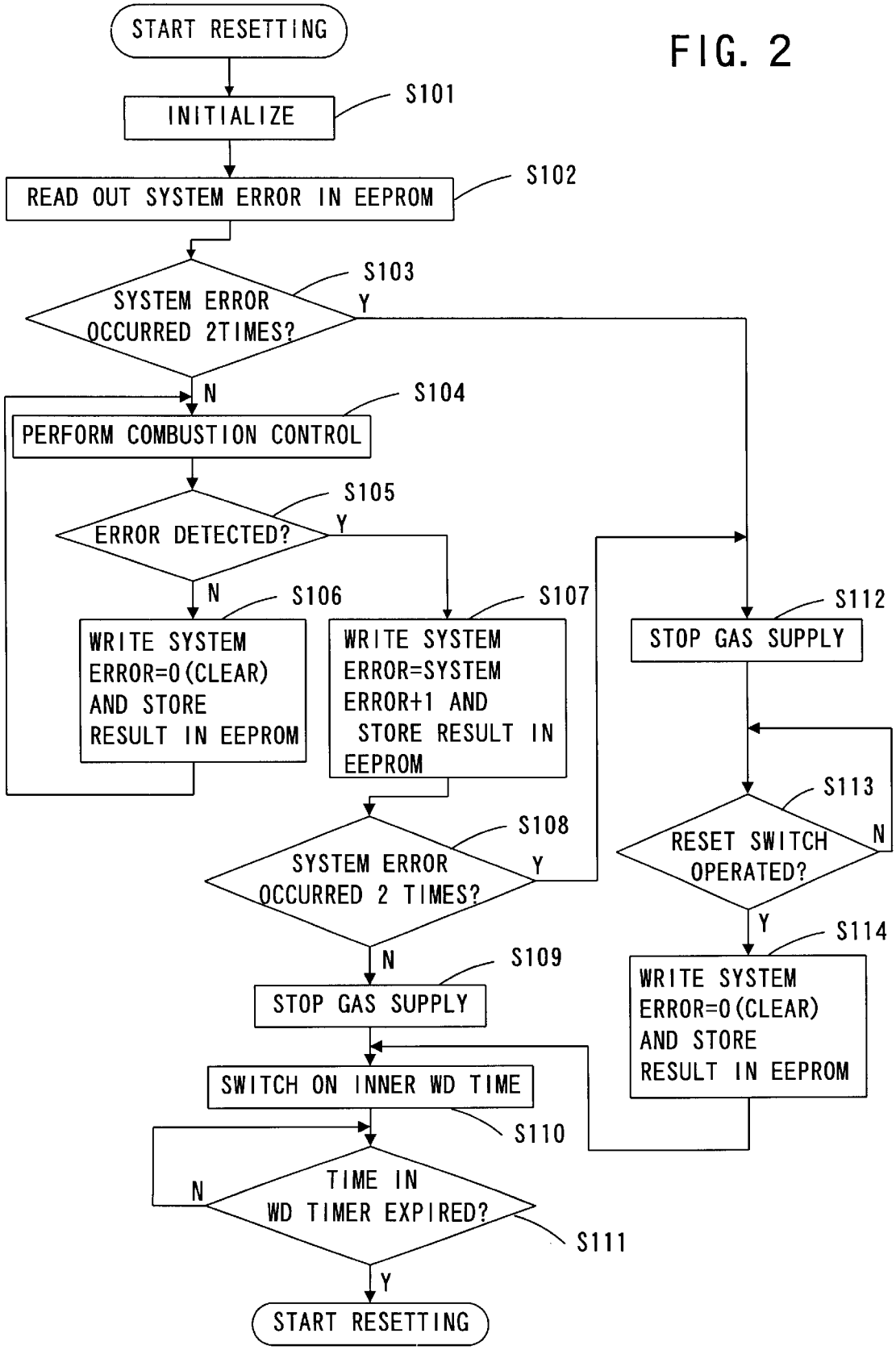
FIG. 2 is a flow diagram to show the processing at the time of occurrence of a system error.

In the embodiment of the present invention, the way of processing after detecting the abnormal condition in the system error is made different from that in the operation error. The processing for the system error is described with reference to FIG. 2. First, if the electric power is switched on, initializing is performed to set various parameters or the like to initial states (S101). Then, that number of the system error which is recorded in the EEPROM 5 is read out (S102). Since the number of system error to be read out for the first time is zero, the program proceeds from step S103 to step S104, where an ordinary combustion control is performed. During the combustion control, the error detection is always continued (S105). If no error is detected, "0" is kept on being rewritten in the EEPROM 5 as the number of occurrence of the system error (S106).

If a system error occurs during the combustion control, the program proceeds from step S105 to step S107, where "1" is added to the number of occurrence of the system error. Also, the value added as the number of occurrence of the system error is stored in the EEPROM 5. In this case, since the value after the addition is "1", the program proceeds from step S108 to step S109, where the safety valve 3 is closed. By means of an inner watchdog timer (WD timer), the microcomputer 4 is reset by software (S110, S11).

If the microcomputer 4 is reset by software, the program returns to step S101 again for performing the initializing operation. Thereafter, that number of the occurrence of abnormal conditions which is stored in the EEPROM 5 is read out (S102). At this point of time, since the number of occurrence of the abnormal conditions is 1, the program proceeds from step S103 to step S104 thereby performing an ordinary combustion control (S104) again. If a system error occurs again during the combustion control, the program proceeds, like at the time of the first occurrence, from step S105 to step S107, where "1" is added to the number of occurrence of the system error. The number of the occurrence is stored in the EPROM 5. Since the number of occurrence was already 1, the number of occurrence after another addition of "1" becomes "2." Then, the program proceeds from step S108 to step S112. As a result, the safety valve 3 is closed and the operation of the combustion device becomes a stopped or suspended condition. The program then proceeds to step S113 and waits until the reset switch 6 is operated.

The reset switch 6 is operated by the operator of the combustion device after having confirmed the occurrence of the system error. The fact that the reset switch 6 is operated justifies a judgement that the system error occurred this time will be resolved. Therefore, the number of occurrence of the system error is reset to "0" and, after storing "0" in the EEPROM 5, resetting is performed (S114, S110, S111).

If the power switch 7 is switched off and the power resetting is actuated in a state in which the reset switch 6 is kept waiting to be operated at step S113, initialization is made at step S101. Thereafter, since that number of occurrence of the system error which is read out from the EEPROM 5 is 2 times, the program proceeds from step S103 directly to step S112. The combustion device becomes a state in which the operation thereof is stopped or suspended without being subject to combustion control. The reset switch 6 is kept waiting to be operated at step S113. It follows that, when the system error has occurred 2 times, which corresponds to a predetermined number of times, the operation of the combustion device will never be resumed unless the reset switch 6 is operated.

As described herein above, in the present embodiment, even if the system error occurs once, the program will not become a state in which the reset switch 6 is kept waiting to be operated. It is only after the occurrence of two times of the system error that the program becomes a state in which the reset switch 6 is kept waiting to be operated. The reason for the above arrangement is that the system error may be wrongly detected through noises or the like. Therefore, if the operation of the combustion device is arranged not to be resumed without the operation of the reset switch 6 even in case of the wrong detection, the number of operation of the reset switch 6 increases. By employing the above-described arrangement, on the other hand, such a troublesome operation can be prevented.

Figure 3:
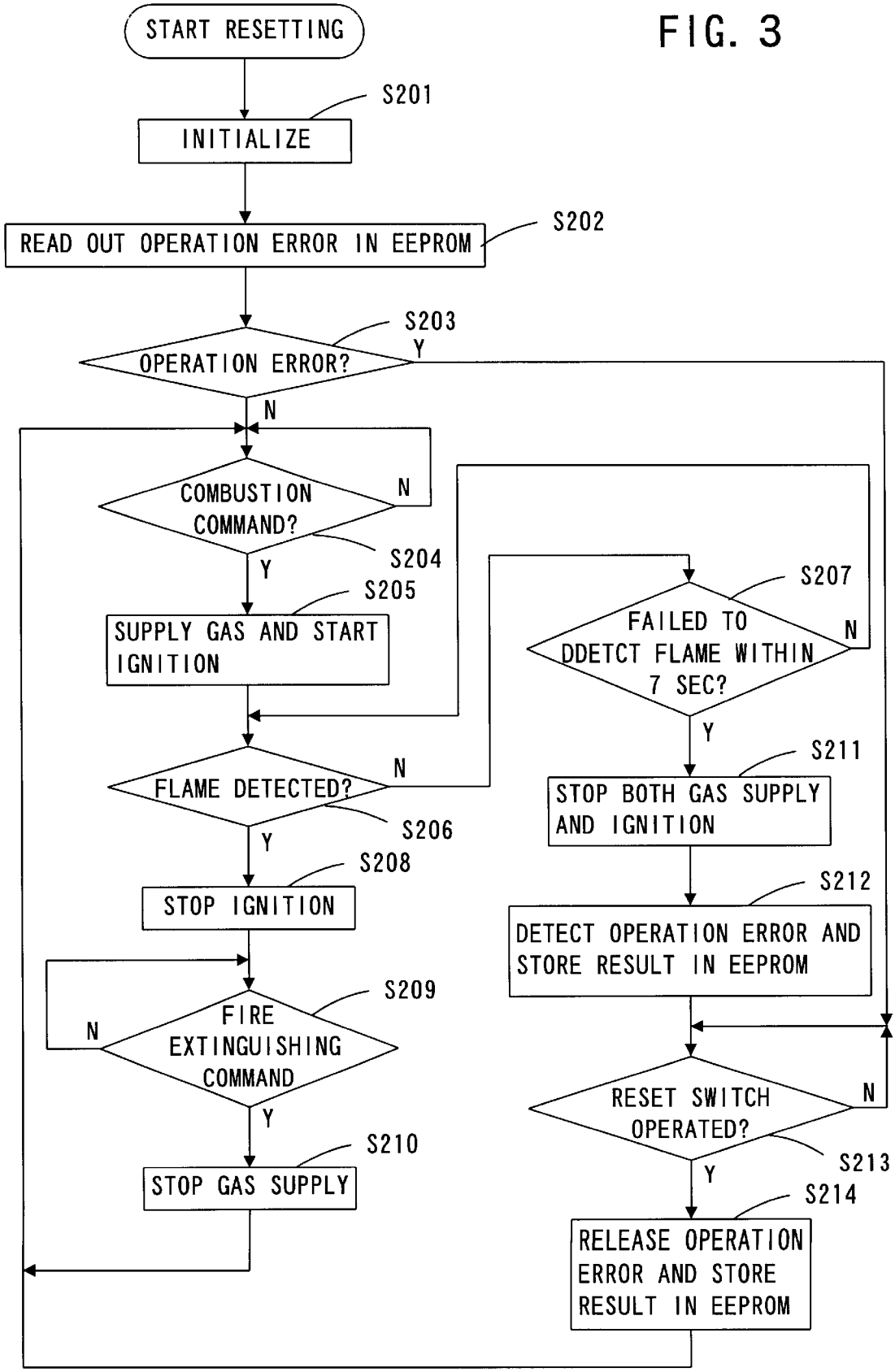
FIG. 3 is a flow diagram to show the processing at the time of occurrence of an operation error.

An explanation will now be made about the operation error with reference to FIG. 3. First, like in the above-described example, after initialization (S201), a reading out is made out of the EEPROM 5 as to whether an operation error has occurred or not (S202). Since, at this stage, the program is in a state in which no operation error has occurred, the program proceeds to step S204, where the microcomputer 4 is kept waiting until an ignition switch (not illustrated) is operated thereby inputting a combustion command signal.

Once the ignition switch is operated, the safety valve 3 is opened and, also, an ignition device (IG) is operated to charge an ignition plug (not illustrated) with a high voltage. A spark is thus generated between the ignition plug IG and the gas burner 2 thereby igniting the gas burner 2. Once the gas burner 2 has been ignited and a flame is generated, the flame is detected by the flame rod 21. If the flame is detected within 7 seconds of the start of the spark (S207), the sparking is stopped (S208). That state, i.e., the state in which the safety valve 3 is kept opened, is maintained (S209) until a fire extinguishing operation is performed. Once the fire extinguishing operation is performed, the program proceeds from step S209 to step S210, where the safety valve 3 is closed and will keep waiting until the ignition switch is operated again (S204).

In case the spark is generated in the ignition plug (S205) but the flame is not detected within a period of time of 7 seconds thereafter, the safety valve 3 is closed and the sparking is stopped (S211). A judgement is thus made that an operation error has been detected, and this information is stored in EEPROM 5 (S212). The program will then become a state in which the operation of the reset switch 6 is kept waiting (S213), and the operation of the combustion device is suspended.

If the reset switch 6 is operated, the program proceeds to step S214, and the state will be made that the operation error has been released, i.e., the state will be that there is no operation error. This information is stored in the EEPROM 5, and the ignition switch is kept waiting to be operated at step S204.

Even if the power reset is actuated by the power switch 7 in a state in which the reset switch 6 is kept waiting to be operated at step S213, the EEPROM 5 contains therein information to the effect that an operation error exists. Therefore, the program proceeds from step S203 directly to step S213 thereby attaining a state in which the operation of the combustion device is suspended.

In the case of the system error, it is only after two times of the occurrence of the system error that the reset switch 6 becomes a state in which the operation thereof is kept waiting. In the case of the operation error, on the other hand, the occurrence of the operation error is hardly wrongly detected under the influence of the noises or the like. Therefore, the program is arranged that the reset switch 6 becomes a state in which the operation thereof is kept waiting even after a single occurrence of the operation error.

In both the above-described system error and the operation error, the number of operation of the reset switch 6 is counted within the predetermined period of time. The program is so arranged that, if the number of counting has reached an upper limit value, the microcomputer 4 is not reset even if the reset switch 6 is operated. In operating the reset switch 6, it is considered to remove the cause for the above-described lockout error. However, in case the lockout error has occurred through a problem in the environment in which the combustion device is being used, it is necessary to analyze the cause for the lockup error in more detail. Therefore, it is so arranged that the resetting with the reset switch 6 is prohibited.

As explained herein above, according to the present invention, in case there has occurred a predetermined error which is the so-called lockout error, the fact of the occurrence thereof is stored in the nonvolatile memory. Therefore, even if the power resetting or the like is performed or attempted without removing the cause for the error, the program is so arranged that the state of suspending the operation of the combustion device will not be resolved.

It is readily apparent that the above-described apparatus for controlling the combustion device meets all of the objects mentioned above and also has the advantage of wide commercial utility. It should be understood that the specific form of the invention herein above described is intended to be representative only, as certain modifications within the scope of these teachings will be apparent to those skilled in the art.

Accordingly, reference should be made to the following claims in determining the full scope of the invention.

What is claimed is:

1. An apparatus for controlling a combustion device, said combustion device having a microcomputer for detecting various abnormal conditions which occur in said combustion device and for performing a predetermined processing wherein said predetermined processing is optionally stopping an operation of said combustion device when such abnormal conditions have been detected, said apparatus comprising:

a reset switch for resetting said microcomputer;

a nonvolatile memory, wherein, when a particular abnormal condition among the various abnormal conditions has occurred, a number of occurrence of the particular abnormal condition is stored in said nonvolatile memory, and wherein, when said microcomputer is reset without resort to said reset switch, the operation of said combustion device is held in a suspended state until said reset switch is operated if the number of occurrence, stored in said nonvolatile memory, of the particular abnormal condition amounts to a predetermined number.

2. The apparatus according to claim 1, wherein said predetermined number is 2 and wherein said microcomputer is reset by software at a time of first occurrence of said particular abnormal condition.

3. The apparatus according to claim 1, wherein, when a number of operation of said reset switch within a given period of time has reached a predetermined upper limit value, the resetting of said microcomputer by means of said reset switch is temporarily prohibited.

4. The apparatus according to claim 2, wherein, when a number of operation of said reset switch within a given period of time has reached a predetermined upper limit value, the resetting of said microcomputer by means of said reset switch is temporarily prohibited.

5. The apparatus of claim 1 wherein said predetermined processing is stopping an operation of said combustion device.

* * * * *